US006954998B1

(12) United States Patent
Lussier

(10) Patent No.: US 6,954,998 B1
(45) Date of Patent: Oct. 18, 2005

(54) CHASSIS CONSTRUCTION FOR AN ARTICLE OF FOOTWEAR

(75) Inventor: Michel Lussier, Portland, OR (US)

(73) Assignee: adidas International Marketing B.V., (NL)

( * ) Notice: Subject to any disclaimer, the term of this patent is extended or adjusted under 35 U.S.C. 154(b) by 296 days.

(21) Appl. No.: 09/630,938

(22) Filed: Aug. 2, 2000

(51) Int. Cl.[7] ..... A43B 23/00; A43B 5/00; A43B 13/14

(52) U.S. Cl. ..... 36/107; 36/88; 36/31; 36/134; 36/76 R; 36/114

(58) Field of Search ..... 36/107, 30 R, 36/31, 88, 92, 134, 76 R, 67 R, 67 A, 59 R, 36/114, 126, 127, 128, 129

(56) References Cited

U.S. PATENT DOCUMENTS

| | | | | | |
|---|---|---|---|---|---|
| 444,735 | A | * | 1/1891 | Thomas | |
| 1,141,889 | A | * | 6/1915 | Trolle | |
| 1,484,785 | A | * | 2/1924 | Hiss | |
| 1,684,676 | A | * | 9/1928 | Lorenzi et al. | 36/32 R |
| 1,923,365 | A | * | 8/1933 | Gaines | |
| 2,049,598 | A | * | 8/1936 | Tubbs | 36/91 |
| 3,204,347 | A | * | 9/1965 | Snow | |
| 3,237,323 | A | * | 3/1966 | MacNeill | |
| 3,492,744 | A | * | 2/1970 | Bernier et al. | |
| 3,529,370 | A | * | 9/1970 | Bernier et al. | |
| 3,685,175 | A | * | 8/1972 | Granger, Jr. | 36/67 R |
| 3,739,497 | A | * | 6/1973 | Cameron | |
| 4,085,526 | A | * | 4/1978 | Hemmer | 36/59 R |
| 4,393,604 | A | * | 7/1983 | Crowley | 36/67 R |
| 4,766,679 | A | | 8/1988 | Bender | 36/30 |
| 4,864,739 | A | * | 9/1989 | Maestri | 36/43 |
| 5,185,943 | A | * | 2/1993 | Tong et al. | 36/28 |
| 5,473,827 | A | * | 12/1995 | Barre et al. | 36/134 |
| 5,546,680 | A | * | 8/1996 | Barma et al. | 36/108 |
| 5,572,805 | A | | 11/1996 | Giese et al. | 36/30 |
| 5,647,145 | A | * | 7/1997 | Russell et al. | 36/31 |
| 5,713,143 | A | * | 2/1998 | Kendall | 36/145 |
| 5,832,634 | A | | 11/1998 | Wong | 36/107 |
| 5,850,702 | A | * | 12/1998 | Okajima | 36/31 |
| D410,965 | S | * | 6/1999 | Schuette et al. | D2/957 |
| 5,915,820 | A | * | 6/1999 | Kraeuter et al. | 36/114 |
| 5,987,783 | A | * | 11/1999 | Allen et al. | 36/127 |
| 6,016,615 | A | * | 1/2000 | Day | 36/134 |
| 6,199,303 | B1 | * | 3/2001 | Luthi et al. | 36/31 |
| D446,917 | S | * | 8/2001 | Brown | D2/961 |

FOREIGN PATENT DOCUMENTS

| | | | | |
|---|---|---|---|---|
| DE | 297 00 699 U1 | | 4/1997 | |
| WO | 98/20763 | * | 5/1998 | 36/134 |

* cited by examiner

*Primary Examiner*—M. D. Patterson
(74) *Attorney, Agent, or Firm*—Goodwin Procter LLP

(57) ABSTRACT

An article of footwear including a sole with a chassis constructed to provide, in a pre-selected manner, comfort, flexibility, support, and power transfer by varying the configuration, thickness, and/or material of the chassis in various areas of the chassis, thereby providing for varying degrees of stiffness in the footwear.

16 Claims, 13 Drawing Sheets

CHASSIS CONSTRUCTION FOR AN ARTICLE OF FOOTWEAR

TECHNICAL FIELD

The invention relates to the construction of a structural chassis for an article of footwear, such as a football shoe or a soccer shoe. The chassis is constructed to provide, in a pre-selected manner, comfort, flexibility, support, and power transfer by varying the configuration, thickness, and/or material of the chassis in various portions of the chassis, thereby tailoring flexibility and stiffness in the article of footwear.

BACKGROUND INFORMATION

In sports such as football and soccer, speed and maneuverability are desirable skills. Properly designed athletic footwear can assist a player in enhancing those skills. The article of footwear should provide support to areas of the foot that need support, comfort to areas of the foot that need cushioning, flexibility to areas of the foot that need flexibility, and effective power transfer to areas of the foot where such power transfer will provide the most benefit to the wearer.

Conventional shoes manufactured for football and soccer have a stiff plastic outsole upon which studs, or cleats, are either integrally formed or attached. One method whereby desirable properties are optimized in one shoe is to manufacture an outsole with varying thickness and/or hardness (i.e., durometer), thus providing a shoe that provides comfort, support, flexibility, and power transfer to the parts of the shoe that most benefit from these properties; however, manufacturing a traditional molded outsole with variable thickness and hardness is difficult and expensive.

SUMMARY OF THE INVENTION

An athletic shoe that provides comfort, support, flexibility, and effective power transfer can greatly enhance a player's performance. The invention relates to a chassis constructed to provide the desirable properties of comfort, support, flexibility, and effective power transfer without the difficulty and expense of trying to provide these properties in a traditionally molded outsole.

The flexibility offered by a shoe according to one embodiment of the present invention can be enhanced by replacing the hard plastic outsole of a traditional football or soccer shoe with a soft outsole and supplying the stiffness that is required with the hard chassis of the present invention. Additionally or alternatively, the hard plastic outsole of a traditional football or soccer shoe can be replaced with an integrally formed chassis and skin construct according to another embodiment of the present invention.

In one aspect of the invention, the chassis includes three sections or portions. A first section of the chassis is a midfoot portion. Extending generally from the midfoot portion into a toe portion is a forefoot portion. The forefoot portion includes at least one finger-shaped element. Extending generally from the midfoot into a heel portion is a rearfoot portion. The rearfoot portion also includes at least one finger-shaped element.

In one embodiment, one or more finger-shaped elements of the forefoot can extend along the entire length of the forefoot region of the footwear. In another embodiment, one or more finger-shaped elements of the rearfoot can extend along the entire length of the rearfoot region of the footwear.

In other embodiments, the forefoot portion, rearfoot portion, or both can include three finger-shaped elements. The finger-shaped elements can be disposed adjacent to one another forming spaces or slits therebetween. In still other embodiments, the finger-shaped elements of the forefoot can be formed to include fold lines across a width of the forefoot portion. The midfoot portion of the chassis may also be a common midfoot portion. The finger-shaped elements of the forefoot portion of the chassis and any spaces therebetween may also span substantially the entire width of the forefoot region.

Additionally or alternatively, the rearfoot portion can be a single element defining an opening. The opening can be located in a heel region of the rearfoot portion. The opening can be of any shape including, but not limited to, a circle, an oval, a square, a triangle, a rectangle, or a diamond. In another embodiment, the rearfoot portion comprises two elements defining an opening therebetween. The opening may be in the form of a chevron. The chevron may open to either a lateral side or a medial side of the article of footwear.

In another aspect of the invention, the chassis can include a plurality of elements extending generally from a heel portion to a toe portion including a midfoot portion, a forefoot portion, and a rearfoot portion. In one embodiment, the elements can extend substantially along an entire length of an article of footwear. The elements can be adjacent to each other and/or spaced apart, as a function of longitudinal location. In embodiments having spaces, the spaces between the elements may be smaller than an inch, half an inch, or a quarter of an inch. In some embodiments, the elements and any spaces therebetween can span substantially the entire width of the sole.

A further aspect of the invention includes an article of footwear having a sole adapted to accommodate a chassis. In a further embodiment of the invention, an article of footwear includes a sole having a chassis integrally formed with a skin. The chassis can be integrally formed with a skin by processes such as dual injection and reverse injection. Dual injection is the process whereby two or more different materials (injectants) are injected simultaneously into a mold. Reverse injection is the process whereby a first injectant is used to create a mold (or mantel) for the second injectant (or inlays). This is the opposite of the general procedure where the first injectant is injected around the inlays (second injectant). The processes can include a single injection point or multiple injection points. In one embodiment, the chassis/skin construct includes a midfoot portion, a forefoot portion, and a rearfoot portion. In another embodiment, the midfoot portion can be a common midfoot portion. The forefoot portion and the rearfoot portion extend in opposite directions from the midfoot portion toward the toe portion and the heel portion, respectively. The forefoot portion, rearfoot portion, or both the forefoot portion and rearfoot portion can include at least one finger-shaped element. In another embodiment, the chassis/skin construct can include a plurality of elements, each element having a midfoot portion, a rearfoot portion, and a forefoot portion. The elements can extend substantially along an entire length of the article of footwear. The elements can be adjacent to one another and may form spaces therebetween.

In some embodiments, an intermediate layer of material of a liquid or a solid can be disposed optionally between the integrally formed chassis and skin. In one embodiment, the layer of material can be a film. It is desirable that the film be chemically compatible with the chassis and the skin to maintain the integrity of the integrally formed chassis/skin construct. The film may contain graphics printed on the film with inks to enhance the visual appeal of the footwear when used with a transparent skin. The chassis/skin construct can be used as an outsole of an article of footwear.

In another aspect of the invention, the chassis or chassis/skin construct can include at least one lug or root extending from a bottom side of the chassis. The lug can extend into an integrally formed or attached cleat or spike element. The shape of the lug can mimic the shape of the cleat within which the lug extends.

In another aspect of the invention, the thickness of the chassis or chassis/skin construct can be varied. In one embodiment, the thickness of a first portion of the chassis or chassis/skin construct is different from the thickness of a second portion. For example, the first portion and the second portion can be the forefoot and the rearfoot portions, the midfoot and forefoot portions, or the midfoot and rearfoot portions. The first and second portions can also be the individual finger-shaped elements of the forefoot and/or rearfoot portions. In another embodiment, the chassis or chassis/skin construct includes more than two portions, each portion having a different thickness.

In another aspect of the invention, the chassis or chassis/skin construct can be made from two or more materials with differing properties. In one embodiment, the chassis or chassis/skin construct includes a first portion made from a material with properties different from a material of a second portion of the chassis or chassis/skin construct. In another embodiment, the chassis or chassis/skin construct includes more than two portions, each portion being made from materials with differing properties.

These and other objects, along with advantages and features of the present invention herein disclosed, will become apparent to those skilled in the art through reference to the following description of various embodiments of the invention, the accompanying drawings, and the claims.

BRIEF DESCRIPTION OF THE DRAWINGS

In the drawings, like reference characters refer to the same parts throughout the different views. Also, the drawings are not necessarily to scale, emphasis instead generally being placed upon illustrating the principles of the invention.

DESCRIPTION

Embodiments of the present invention are described below. It is, however, expressly noted that the present invention is not limited to these embodiments, but rather the intention is that all equivalents and modifications that are obvious to a person skilled in the art are also included. In particular, the present invention is not intended to be limited to football and soccer shoes, but rather may be used for all types of footwear where comfort, support, flexibility, and effective power transfer are sought.

According to one embodiment of the present invention, an article of footwear includes a chassis that is disposed beneath the foot of the wearer. This can be achieved by integrating the chassis into an outsole of the article of footwear, or sandwiching it between the outsole and a midsole, or between the midsole and an insole. The different possible arrangements of the chassis within the footwear may influence the functional properties of the article of footwear including the chassis; therefore, reference is made to an article of footwear in general.

Figure 1A:
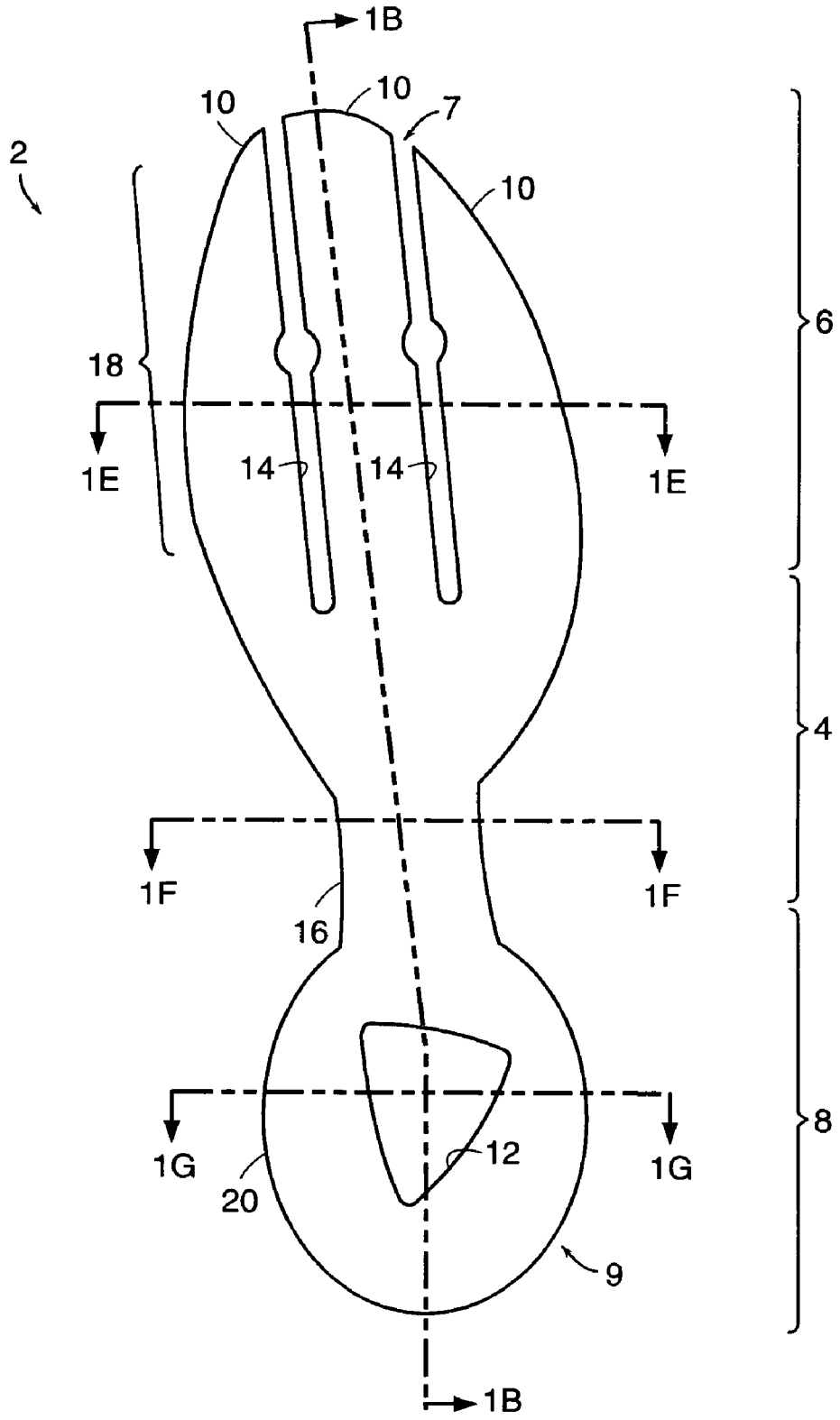
FIGS. 1A–1G are schematic plan and cross-sectional views of one embodiment of the chassis of the present invention.

FIGS. 1A–1G depicts one embodiment of a chassis 2 of the present invention. FIG. 1A shows a plan view of the bottom of the chassis 2. The chassis 2 includes a common midfoot portion 4, a forefoot portion 6, and a rearfoot portion 8. Lines of demarcation between these portions are not fixed and may vary as a function of chassis design. The forefoot portion 6 and the rearfoot portion 8 extend from the midfoot portion 4 in opposite directions to a toe portion 7 and a heel portion 9, respectively. The forefoot portion 6 can include one or more finger-shaped elements 10, such as the three depicted in this embodiment. The finger-shaped elements 10 can be adjacent one another and may form spaces 14 therebetween. The spaces 14 between the finger-shaped elements 10 can extend from the midfoot portion 4 to the end of the forefoot portion 6. The spaces 14 need not be of uniform width and need not be partially or wholly linear.

The rearfoot portion 8 can include a single element 20 defining an opening 12. The opening 12 of the rearfoot portion 8 can be any shape. For example, the shape of the opening 12 can include, but is not limited to, a triangle, a circle, a square, a rectangle, or a chevron. Alternatively or additionally, the single element 20 of the rearfoot portion 8 can define more than one opening 12 and can open out to the medial side or the lateral side of the rearfoot portion 8.

Referring still to FIG. 1A, the chassis 2 may be designed to provide support to those areas of the article of footwear where a user would most benefit from having such support. For example, the chassis 2 has stiff finger-shaped elements 10 that are positioned above a row of cleats affixed to the outsole as shown in the embodiment depicted in FIGS. 2A–2G. This improves the distribution of pressure caused by the lugs and cleats and enhances a wearer's comfort of the finished article of footwear. Also, a shank area 16 of the footwear typically requires strong support. Therefore, the chassis 2 can be designed to cover the entire midfoot portion 4 without openings or slits. The stiff chassis 2 also provides the necessary support needed when a soft outsole, such as one made of soft thermoplastic polyurethane or equivalent materials, is used instead of a traditional hard sole.

Areas of the footwear that require more flexibility typically require a less stiff chassis 2, allowing those areas to be more compliant to pressure. The design of the chassis 2, as well as the selection of material, can provide even greater flexibility. For example, certain areas of the forefoot portion 6, such as the finger-shaped elements 10 and the spaces 14 in the forefoot portion, form a forefoot flex zone 18. The forefoot flex zone 18 allows for greater maneuverability, especially when a wearer, such as a football player, needs to change directions quickly. Therefore, even with stiff finger-shaped elements 10 of the forefoot portion 6 for providing effective power transfer for toe off, the flexibility of the footwear can be improved by the use of a soft outsole, instead of the traditional hard outsole. A soft outsole allows for greater flexibility because the wearer can use the spaces 14 between the finger-shaped elements 10 to take advantage of the soft, flexible, and compressible outsole, instead of being limited in movement by the traditional hard, relatively inflexible outsole.

An additional advantage provided by the finger-shaped elements 10 and spaces 14 therebetween over the conventional stiff plates or inflexible outsoles is that the chassis 2 of the present invention allows the wearer to better "feel" the position of his foot relative to the ground. The design of the finger-shaped elements 10 allows the elements 10 to contort somewhat independently from each other in response to the position of the foot relative to the ground or the forces that are being applied to different areas of the foot. In contrast, the conventional stiff plate or inflexible outsoles tends to homogenize or mute the sensory input felt by the foot in response to the forces applied and the position of the foot relative to the ground.

The chassis 2 of the present invention allows a user to be in better communication with his environment. When a user's ability to feel his foot working as he maneuvers over the ground is enhanced, it can increase his perception of his body in relation to his surroundings and increase his confidence in the consequences of his actions. One benefit is that he will be able to commit more of his energies to a given movement more quickly, without fear of a misstep or injury.

Figure 1B:
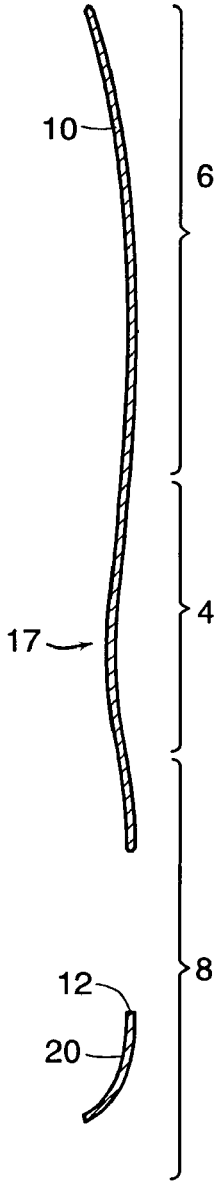
Figure 1C:
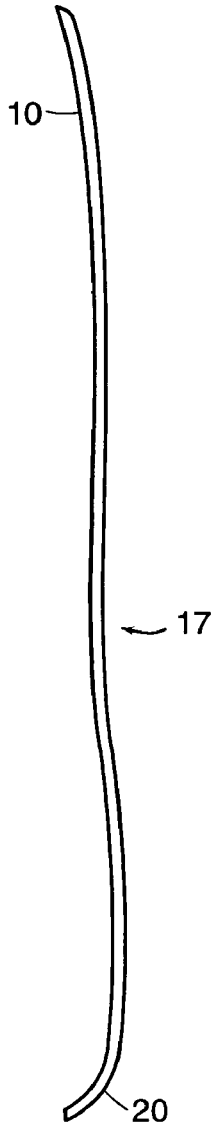
Figure 1D:
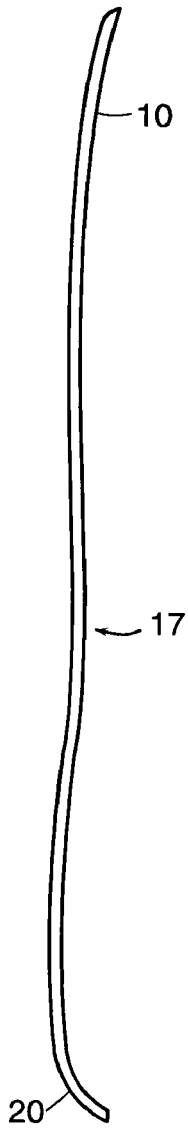

FIGS. 1B–1D show a schematic cross-sectional view along section 1B—1B, a lateral side view, and a medial side view of the chassis 2, respectively. The forefoot portion 6 extends generally from the midfoot portion 4 into the toe portion 7. The rearfoot portion 8 extends generally into the heel portion 9. The opening 12 is defined by the singular finger-shaped element 20 of the rearfoot portion 8. The chassis 2 is generally planar; however, the chassis 2 may be contoured to better conform to the shape of a foot. For example, FIGS. 1B–1D show the chassis 2 offset in an arch region 17 to support a wearer's arch. The chassis 2 may also have a three-dimensional shape. Examples of three-dimensional elements are side elements 128 and lugs or roots 130, described further in FIGS. 2A–2G.

Figure 1E:
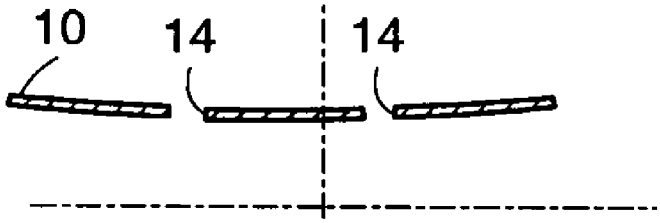
Figure 1F:
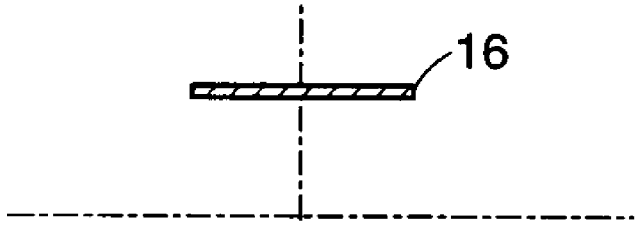
Figure 1G:
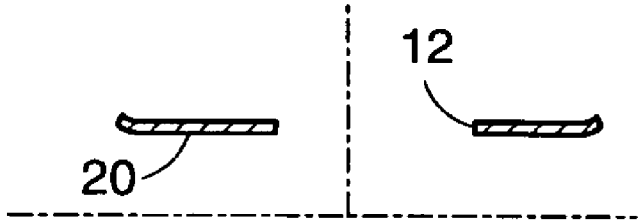

FIGS. 1E–1G show schematic views of cross-sections 1E—1E, 1F—1F, and 1G—1G of the chassis 2 of FIG. 1A, respectively. Between the finger-shaped elements 10 of the forefoot portion 6 are spaces 14 to allow for greater flexibility. The midfoot portion 4 includes the shank area 16. The rearfoot portion 8 includes the finger-shaped element 20 defining an opening 12.

Figure 2A:
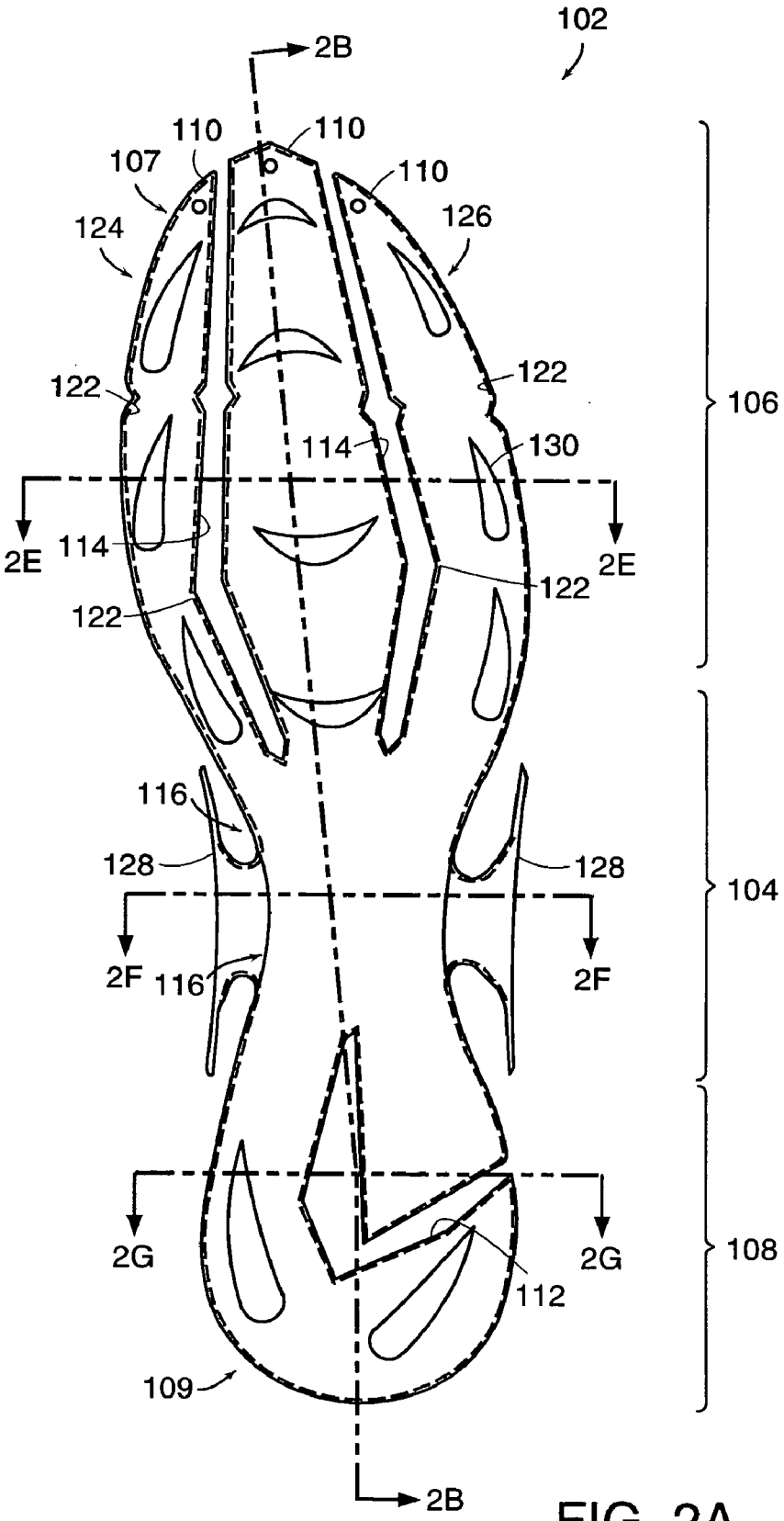
FIGS. 2A–2G are schematic plan and cross-sectional views of another embodiment of the chassis of the present invention.

FIG. 2A depicts a bottom plan view of another embodiment of the chassis 102 of the present invention. In this embodiment, a forefoot portion 106 and a rearfoot portion 108 extend into a toe portion 107 and a heel portion 109, respectively. In this embodiment of the chassis 102, the finger-shaped elements 110 in the forefoot portion 106 have fold lines 122 as well as spaces 114 therebetween. The fold lines 122 and spaces 114 of the finger-shaped elements allow for greater flexibility in the forefoot region 106. In the process of walking or running, the forefoot region 106 of a wearer bends as he shifts his weight from his heel to his forefoot and then pushes off with the forefoot. These finger-shaped elements 110 and spaces therebetween 114 allow for greater and easier bending in this region.

The chassis 102, as shown in FIGS. 2A–2G, can also include lugs or roots 130. The lugs 130 extend from the bottom side of the chassis 102 and generally mimic the shape of a cleat, filling an interior portion thereof. The lugs 130 and chassis 102 can form a system to provide enhanced comfort, flexibility, and power transfer. A lug 130 can extend from the bottom side of the chassis 102 into the cleat. The chassis 102 and lugs 130 work together to create a system to provide greater comfort to the wearer and greater power to his movements.

Lugs 130 extend from the bottom side of the chassis into the cleat of an article of footwear. The weight of the wearer, and any additional forces that are applied to his feet when a wearer moves, can be felt in that area of the foot above the cleats. This pressure is known as the point load, and it can produce an unpleasant ache in that local area of the foot. In the present embodiment, pressure exerted by the cleats are transferred to the lugs 130 which then allow the pressure to be dispersed to a larger area, i.e., throughout the chassis, thus eliminating the uncomfortable point load. Thus, the wearer would never feel the pressure exerted by any individual lug 130 even if he were to apply all his weight and force to only one lug 130.

Moreover, the flexibility afforded by the finger-shaped elements 110 also lends itself to more powerful movements and control of the movements. The interconnected lugs 130 and the flexibility of the chassis 102 allow more cleats to be in contact with the ground, allowing the wearer to have more control over his movements (e.g., stop, go, and turn) and produce more forceful movements. This flexibility also lends itself to an increased ability of the user to "feel" the ground, as discussed previously. As a lug 130 is placed on the ground, that lug 130 tends to pull the other interconnected lugs 130 along a finger-shaped element 110 also to the ground. This system allows more cleats along a longitudinal length of the forefoot region 106 to be in contact with the ground. In addition, the spaces 114 between the finger-shaped elements 110 allow the finger-shaped elements 110 to bend longitudinally along the length of the finger-shaped elements 110, as well as allowing for some torsional rotation of each finger-shaped element 110. This flexibility allows more cleats along a lateral width to be in contact with the ground. For example, with a traditional chassis or hard outsole, a runner making a sharp left-handed turn will have only his cleats on the medial side of his outside running foot pushing off the ground. The flexibility of the chassis 102 of the present invention may allow the central as well as the lateral cleats to be in contact with the ground during push off. Thus, it would be a rare situation where all the weight of a wearer and/or the force of his movements would be borne on only one lug 130.

As well as providing for more flexibility and comfort, the chassis 102 may also provide for greater power transfer. The material of the chassis 102 may be one with good shape memory characteristics. A material that has a good memory is one that quickly and/or easily returns to its original shape after the force loads are removed from the elastically deformed material. A chassis 102 made of such a material allows the energy expended by the wearer to deform the chassis 102 and, when he rolls to the balls of his feet, to return the energy to the wearer when the deformed chassis 102 returns to its original shape. The better the memory of a material of the chassis 102, the greater the energy returned to the wearer.

Figure 3A:
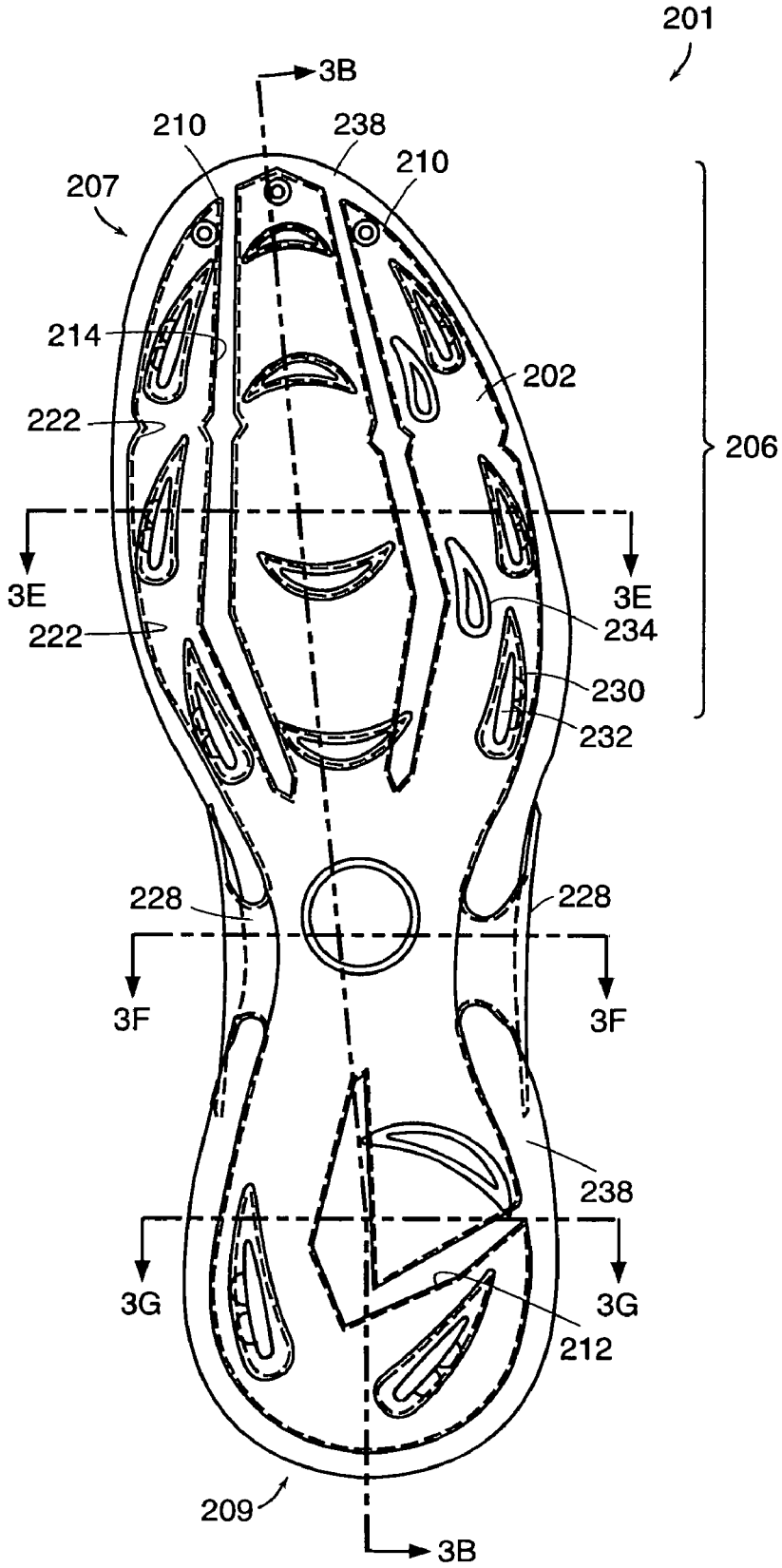
FIGS. 3A–3I are schematic plan, side, cross-sectional, and end views of one embodiment of the chassis/skin construct of the present invention.

The opening 112 in the heel portion 108, in this embodiment, is in the shape of a chevron. Similar to the triangular opening 12 shown in FIG. 1A, the chevron shaped opening 112 allows for comfort as it provides cushioning in the heel region 109; however, this shape can also accommodate the cleat formation in the heel region 209 as shown in FIG. 3A. The chevron opens to the lateral side 126 of the chassis 102 for added comfort in the heel region 109, allowing more cushioning; however, it is contemplated that the chevron may open to the medial side 124 of the chassis 102.

The chassis 102 can be three-dimensional. For example, the chassis 102 may include side elements 128 extending outward and upward from the midsole 104 on the medial side 124 of the chassis 102 and the lateral side 126 side of the chassis 102. One advantage of side elements 128 is that the design of the side element can be adjusted to provide more or less support in the shank region 116. Support in the shank region 116 can be tunable by adjusting the side elements 128, the durometer of a material, and/or the thickness of the material.

Figure 2B:
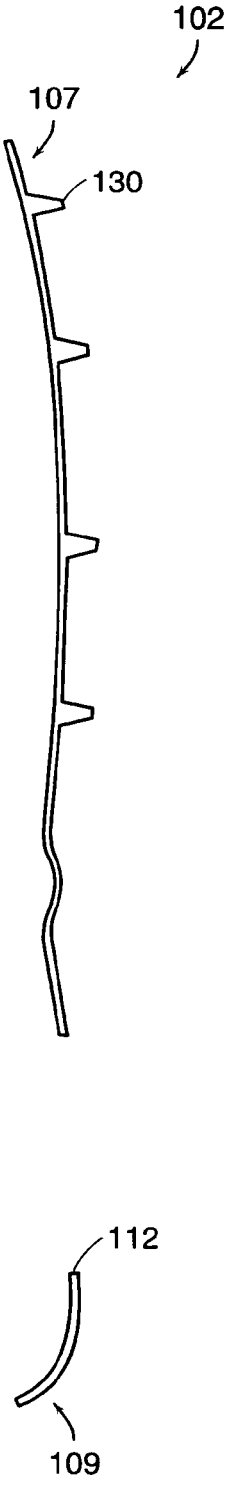
Figure 2C:
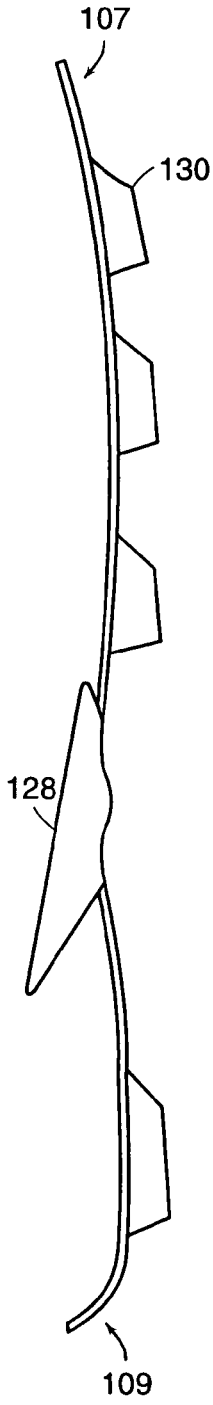
Figure 2D:
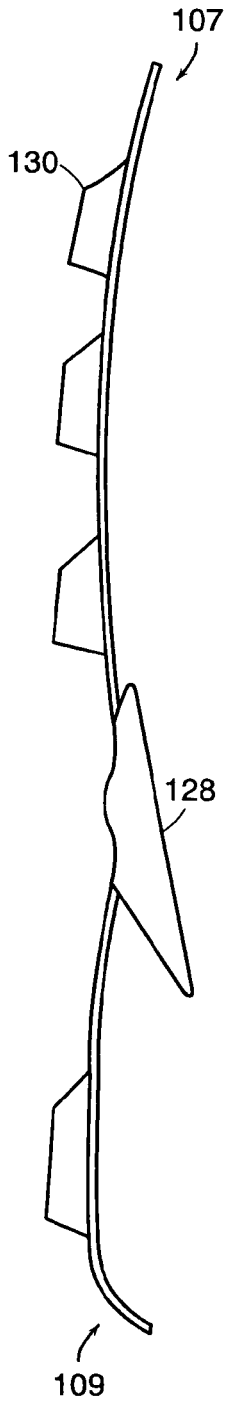
Figure 2E:
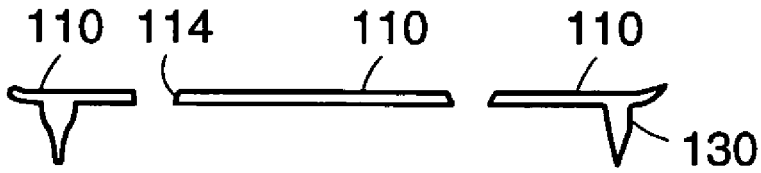
Figure 2F:
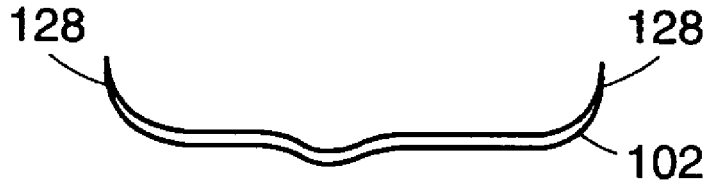
Figure 2G:
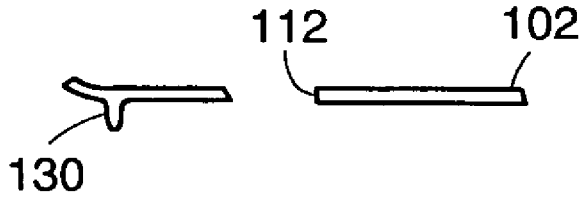

FIGS. 2B–2D show a cross-sectional view along section 2B—2B, a lateral side view, and a medial side view of FIG. 2A. FIGS. 2E–2G show cross-sectional views along sections 2E—2E, 2F—2F, and 2G—2G of FIG. 2A.

FIGS. 3A–3I depict still another embodiment of the chassis 202 of the present invention. In this embodiment, the chassis 202 is integrally formed with a skin 238. Also included are side elements 228. Cleats 234 extend from a bottom side of the chassis/skin construct 201. Lugs 230 extend from the bottom side of the chassis 202 into some of the cleats 232. Other cleats 234 may not have lugs. As described above, the lugs 230 and chassis 202 form a system for improved comfort, greater maneuverability, and more powerful movements.

Figure 3B:
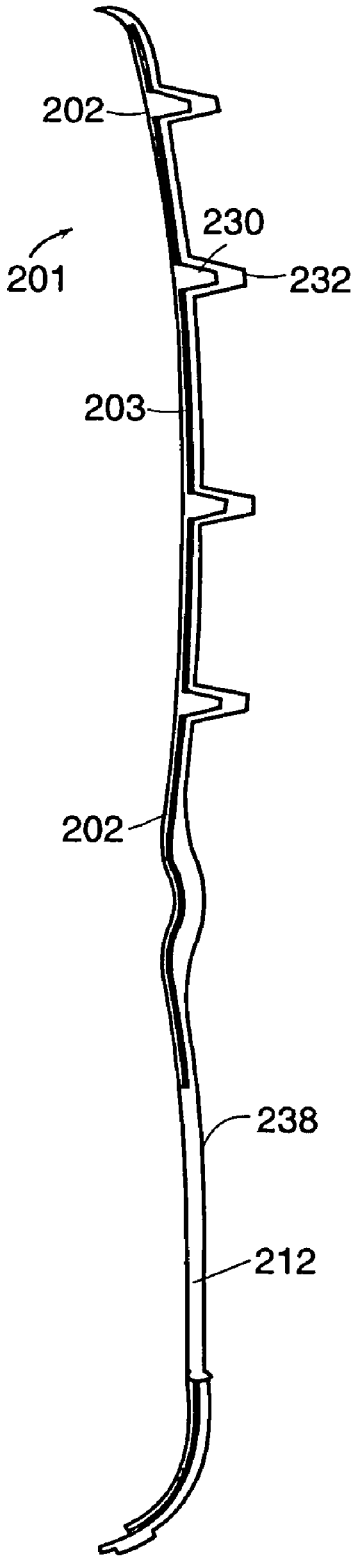
Figure 3C:
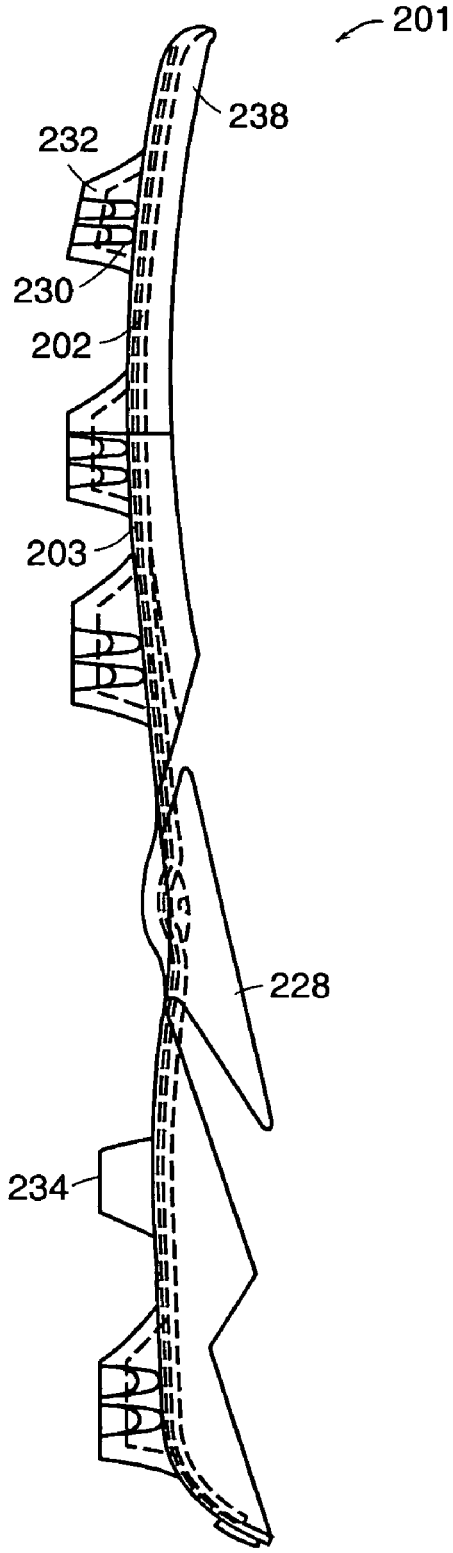
Figure 3D:
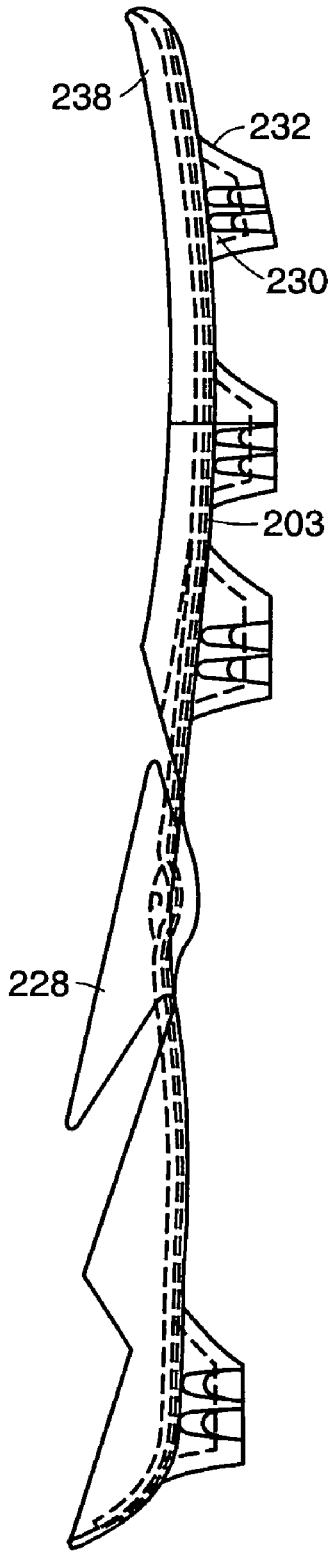
Figure 3E:
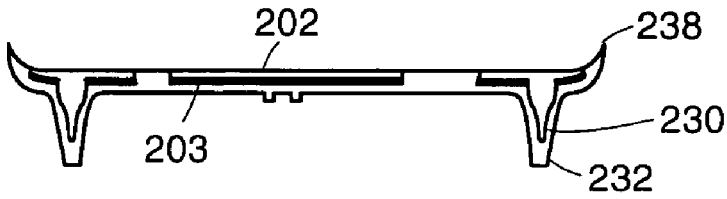
Figure 3F:
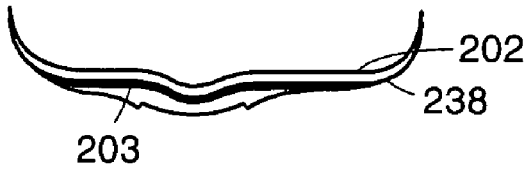
Figure 3G:
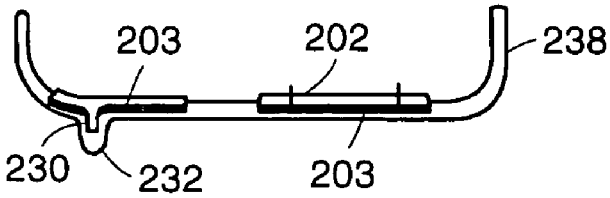
Figure 3H:
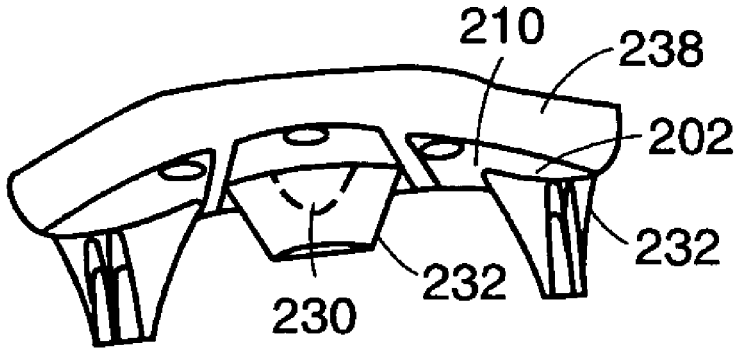
Figure 3I:
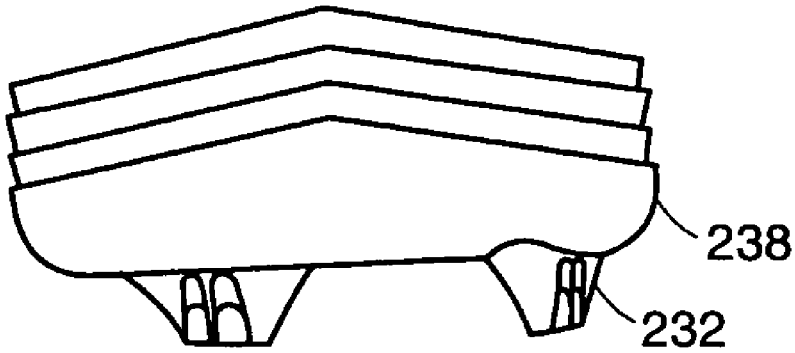

FIG. 3A shows a plan view of the bottom side of the chassis/skin 201, having a midfoot portion 204 and a rearfoot portion 208. The finger-shaped elements 210 in the forefoot region 206 have fold lines 222 to facilitate flexing at these regions. The forefoot region 206 includes a toe portion 207. The opening 212 in the heel portion 209 is in the shape of a chevron. FIGS. 3B–3D show a cross-sectional view along section 3B—3B, a medial side view, and a lateral side view, respectively, of the chassis/skin construct 201. FIGS. 3E–3G show cross-sectional views along sections 3E—3E, 3F—3F, and 3G—3G of the chassis/skin construct 201. FIGS. 3H–3I show end views of a toe view and a heel view, respectively.

The chassis 2, 102, 202 can be composed of any suitable polymeric material or combination of polymeric materials, either with or without reinforcement. Suitable materials may include: thermoplastic polyurethane (TPU); thermoplastic polyether block amides, such as the Pebax® brand sold by Elf Atochem; thermoplastic polyester elastomers, such as the Hytrel® brand sold by DuPont; nylon 12, which may include 10 to 30 percent or more glass fiber reinforcement; and equivalent materials. Reinforcement, if used, may be by inclusion of glass or carbon graphite fibers or para-aramid fibers, such as the Kevlar® brand sold by DuPont, or other similar method. Other suitable materials will be apparent to those skilled in the art.

The material of the chassis 2, 102, 202 may advantageously possess good memory. This quality is desirable since, as discussed previously, the better the memory, the greater the ability of the material, and hence the chassis 2, 102, 202, to transmit energy back to the wearer.

In chassis/skin constructs 201, the chassis 202 and skin 238 can be integrally formed by a process called reverse injection. The skin 238 itself forms the mold for the chassis 202. Such a process is more economical than conventional methods, because a separate chassis mold is not required. The chassis/skin 201 can also be formed in a single step called dual injection, where two or more materials are injected simultaneously to integrally create the chassis 202 and the skin 238. These processes can also include multiple points of injection for the material for the chassis 202 and skin 238. The presence of these multi-injection points allows the manufacturer to produce very thin, but supportive structures. This is in contrast to a process with a single point of injection where it is very difficult to create a thin structure, as thin areas of the mold will tend to impede the flow of the viscous injectant into the mold, resulting in incomplete filling, referred to by those of skill in the art as a short shot.

The material for the chassis 202 and skin 238 should be "compatible." Being compatible means that the chassis 202 and skin 238 should be able to chemically bond to each other after the process of integrally forming them. It is also desirable that the material for the chassis 202 and skin 238 have similar limit radii. A limit radius is known in the art as the curvature of a length of material when pressure is applied to bend it, without destroying the integrity of the material. Because the chassis/skin construct 201 must undergo numerous amounts of bending and twisting when in use, a chassis 202 with a limit radius that is sufficiently different from the limit radius of the skin 238 could potentially cause the chassis 202 and skin 238 to separate because one material would have a greater resistance to bending than the other. In other words, the greater resistance of one material can cause the two materials to be in tension with each other and, thus, can potentially destroy the chemical bond between the chassis 202 and skin 238.

It is also contemplated that an intermediate layer 203 of a liquid or a solid material, such as a thin film, can be disposed between the chassis 202 and skin 238 and that all three components (the chassis 202, intermediate layer 203, and skin 238) are compatible with each other to create an integrally formed chassis/skin 201 structure. The intermediate liquid or solid material may be any material that allows the chassis 202 and skin 238 to be compatible as defined herein. For example, the intermediate layer 203 may be an ink, a powder, a fabric, or a film of a natural or synthetic material. In one embodiment, the film is created with a color and/or design and the skin 238 is made of a transparent material so that the color and/or design of the film can be readily viewed through the skin 238 to enhance visual appeal.

The sole can be composed of any suitable polymeric material or combination of polymeric materials, such as the materials discussed above, or more specifically, ethylene vinyl acetate (EVA), Pebax 5533, Pebax 6333, Pebax 7033, thermoplastic polyurethane-ether, such as TPU-ether 500, or thermoplastic polyurethane ester. If, however, the chassis/skin construct 201 is to be used as an outsole, it is desirable that the skin 238 offer excellent wear/abrasion resistance.

The chassis 2, 102, 202 or chassis/skin construct 201 can be designed to provide more stiffness in certain areas of the article of footwear and less stiffness in other areas. The stiffness of the chassis 2 can be controlled by varying the thickness, hardness, and/or width of the chassis 2, 102, 202 or chassis/skin construct 201. The thicker, harder, or wider the material in a particular area of the chassis 2, 102, 202, or chassis/skin construct 201, the stiffer the chassis 2, 102, 202 or chassis/skin construct 201 will typically be in that area. Thus, the chassis 2, 102, 202 or chassis/skin construct 201 can be designed to provide greater stiffness in one area of the chassis 2, 102, 202 or chassis/skin construct 201 than another area.

The chassis 2, 102, 202, or chassis/skin construct 201 can also be designed to provide more stiffness to certain areas of the article of footwear and less stiffness to other areas by varying the types of material used to manufacture the chassis 2, 102, 202 or chassis/skin construct 201. Thus, stiffer materials can be placed in areas requiring greater support and power transfer and less stiff materials can be placed in areas requiring greater flexibility, such as a forefoot flex region. The different shading in FIGS. 1A, 2A, and 3A defines, by way of example, areas where the various types of materials may be used.

Figure 4:
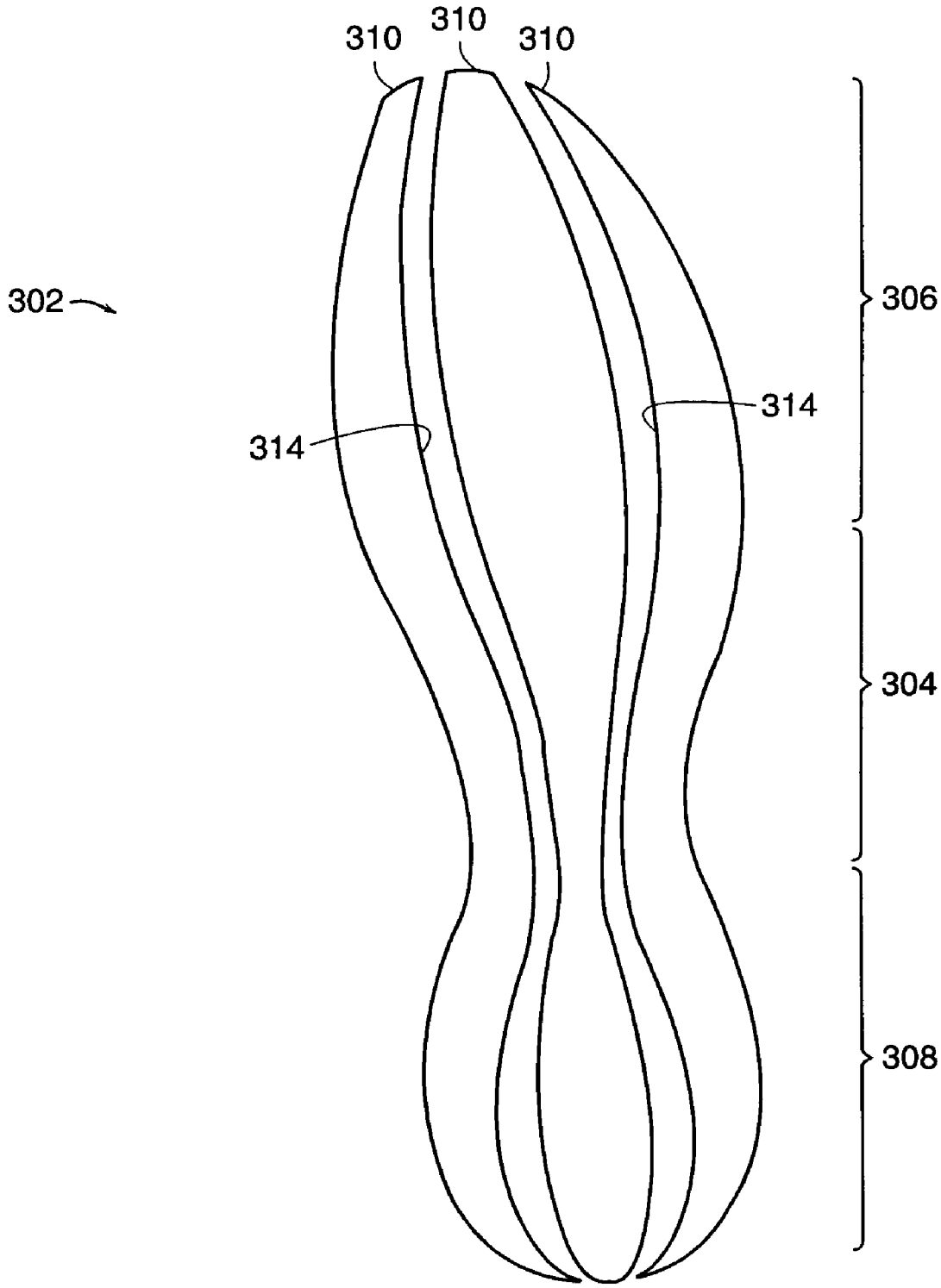
FIG. 4 is a schematic plan view of another embodiment of a chassis of the present invention.

FIG. 4 shows another embodiment of the chassis 302 of the present invention. The chassis 302 includes three elements. In this embodiment, each element 310 includes a forefoot portion 306, a midfoot portion 304, and a rearfoot portion 308. The elements 310 extend substantially the entire length of an article of footwear. The elements 310 lie adjacent to one another and may form spaces 314 therebetween, as depicted. In a preferred embodiment, the chassis 302 is designed to support and work with cleats. Thus, elements 310 are placed and spaced in the footwear to support a cleat extending directly or indirectly from the bottom of the element 310. As above, the different shading in FIG. 4 defines, by way of example, areas where differing types of materials may be used.

The sole can be manufactured with a suitable configured recess to house the chassis 2, 102, 302. Alternatively, a sole including the chassis 2, 102, 302 can be manufactured by inserting the chassis 2, 102, 302 into an injection mold that may be used to produce a sole, and then injecting a polymer or similar material into the mold. Other methods of manufacturing the sole are the processes for chassis/skin construct 201 discussed previously. The materials forming the chassis 2, 102, 202, 302 and skin 238 can be injected in the same processing step to create the chassis/skin construct 201. This dual injection process allows the manufacturer to vary the thickness and/or durometer of the material of the chassis 2, 102, 202, 302 and/or skin 238 according to a wearer's needs and/or to a particular sport. In a reverse injection process, the materials forming the skin 238 can be used as a mold for the chassis 2, 102, 202, 302. Both of the latter methods described are more economical than the conventional process. Multi-point injections of the chassis 2, 102, 202, 302 and skin 238 also permit areas of the chassis 2, 102, 202, 302 to be thin, while still maintaining the chassis's structural integrity. In other words, the chassis can be very thin and still provide stiffness and support as needed. In an alternative method of manufacturing the claimed invention, the chassis 2, 102, 202, 302 and skin 238 can be sandwiched and/or bonded together by other means known in the art to form a single unit.

Having described preferred and exemplary embodiments of the invention, it will be apparent to those of ordinary skill in the art that other embodiments incorporating the concepts disclosed herein can be used without departing from the spirit and scope of the invention. The described embodiments are to be considered in all respects only as illustrative and not restrictive. Therefore, it is intended that the scope of the present invention be only limited by the following claims.

What is claimed is:

1. A single piece generally planar polymeric chassis for installation in an article of footwear, the chassis comprising:

a medial side;

a lateral side;

a midfoot portion;

a forefoot portion, including a plurality of elongated elements that extend from the lateral side to the medial side, and from the midfoot portion into substantially an entire length of the forefoot portion, the plurality of elongated elements defining at least one space therebetween extending from a forwardmost extent of the forefoot portion and terminating in the midfoot portion; and a rearfoot portion, including at least one elongated element that extends from the midfoot portion into substantially an entire length of a heel portion of the chassis;

wherein at least one elongated element comprises at least one indentation along a width of the chassis.

2. A single piece generally planar polymeric chassis for installation in an article of footwear, the chassis comprising:

a medial side;

a lateral side;

a midfoot portion;

a forefoot portion, including a plurality of elongated elements that extend from the lateral side to the medial side, and from the midfoot portion into substantially an entire length of the forefoot portion, the plurality of elongated elements defining at least one space therebetween extending from a forwardmost extent of the forefoot portion and terminating in the midfoot portion; and a rearfoot portion, including at least one elongated element that extends from the midfoot portion into substantially an entire length of a heel portion of the chassis;

wherein the rearfoot portion comprises two elements defining an opening therebetween; and wherein the opening is in a form of a chevron.

3. The chassis of claim 2, wherein the chevron opens to one of the medial side or the lateral side of the chassis.

4. A single piece generally planar polymeric chassis for installation in an article of footwear, the chassis comprising:

a medial side;

a lateral side;

a midfoot portion;

a forefoot portion, including a plurality of elongated elements that extend from the lateral side to the medial side, and from the midfoot portion into substantially an entire length of the forefoot portion, the plurality of elongated elements defining at least one space therebetween extending from a forwardmost extent of the forefoot portion and terminating in the midfoot portion; and a rearfoot portion, including at least one elongated element that extends from the midfoot portion into substantially an entire length of a heel portion of the chassis;

wherein a thickness of a first portion of the chassis is different than a thickness of a second portion of the chassis.

5. The chassis of claim 4, wherein the first portion of the chassis comprises the forefoot portion and the second portion comprises the rearfoot portion.

6. The chassis of claim 4, wherein the first portion of the chassis comprises a first elongated element and the second portion comprises a second elongated element.

7. The chassis of claim 4, wherein the first portion of the chassis comprises the midfoot portion and the second portion comprises the forefoot portion.

8. The chassis of claim 4, wherein the chassis comprises more than two portions, each comprising a different thickness.

9. A single piece generally planar polymeric chassis for installation in an article of footwear, the chassis comprising:

a medial side;

a lateral side;

a midfoot portion;

a forefoot portion, including a plurality of elongated elements that extend from the lateral side to the medial side, and from the midfoot portion into substantially an entire length of the forefoot portion, the plurality of elongated elements defining at least one space therebetween extending from a forwardmost extent of the forefoot portion and terminating in the midfoot portion; and a rearfoot portion, including at least one elongated element that extends from the midfoot portion into substantially an entire length of a heel portion of the chassis;

wherein a first portion of the chassis comprises a material with properties different than a material of a second portion of the chassis.

10. The chassis of claim 9, wherein the chassis comprises more than two portions, each comprising different material properties.

11. A single piece generally planar polymeric chassis for installation in an article of footwear, the chassis comprising:

a medial side;

a lateral side;

a midfoot portion;

a forefoot portion, including a plurality of elongated elements that extend from the lateral side to the medial side, and from the midfoot portion into substantially an entire length of the forefoot portion, the plurality of elongated elements defining at least one space therebetween extending from a forwardmost extent of the forefoot portion and terminating in the midfoot portion;

a rearfoot portion, including at least one elongated element that extends from the midfoot portion into substantially an entire length of a heel portion of the chassis; and at least one lug extending from a bottom side of the chassis.

12. A single piece generally planar polymeric chassis for installation in an article of footwear, the chassis comprising a plurality of elongated elements that extend from a lateral side to a medial side of the chassis and extend substantially along an entire length from a heel portion of the chassis to a toe portion of the chassis, each elongated element comprising:

a midfoot portion;

a forefoot portion; and a rearfoot portion;

wherein the plurality of elongated elements define at least one space therebetween extending from a forwardmost extent of the forefoot portion of the plurality of elongated elements and terminating in the midfoot portion; and wherein the chassis further comprises at least one lug extending from a bottom side of the chassis.

13. An article of footwear including a sole with at least one cleat, the sole comprising a generally planar polymeric chassis, wherein a forefoot portion of the chassis has a lateral side and a medial side, the lateral and medial sides being proximate to corresponding lateral and medial sides of the article of footwear, the chassis extending substantially along an entire length of (i) a heel portion of the article of footwear, and (ii) a toe portion of the article of footwear, and wherein the cleat is proximate to at least one of the lateral and medial sides of the article of footwear;

wherein the polymeric chassis is integrally formed with a skin; and further comprising an externally visible intermediate layer of material between the integrally formed chassis and skin.

14. The article of footwear of claim 13, wherein the intermediate layer of material is a film.

15. The article of footwear of claim 14, wherein the film comprises one of a design, a color, and a combination of a design and a color.

16. A generally planar polymeric chassis for installation in an article of footwear, the chassis comprising at least three elongated elements with generally nonlinear spaces formed therebetween, the elongated elements extending from a lateral side to a medial side of the chassis and extending substantially along an entire length of the chassis from a heel portion of the chassis to a toe portion of the chassis, each elongated element comprising:

a midfoot portion;

a forefoot portion; and a rearfoot portion.

* * * * *